US011585590B2

(12) United States Patent
Caglin et al.

(10) Patent No.: US 11,585,590 B2
(45) Date of Patent: Feb. 21, 2023

(54) SEALING ASSEMBLY FOR COOLING DEVICE DOORS AND COOLING DEVICE HAVING THE SEALING ASSEMBLY

(71) Applicant: BSH Hausgeraete GmbH, Munich (DE)

(72) Inventors: Muharrem Uemit Caglin, Istanbul (AR); Tezcan Cetin, Tekirdag (AR); Ibrahim Tugrul Soenmez, Tekirdag (AR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/224,420

(22) Filed: Apr. 7, 2021

(65) Prior Publication Data

US 2021/0404731 A1 Dec. 30, 2021

(30) Foreign Application Priority Data

Jun. 26, 2020 (TR) ..... 2020/10040

(51) Int. Cl.
*F25D 23/02* (2006.01)
*F25D 23/08* (2006.01)

(52) U.S. Cl.
CPC ..... *F25D 23/028* (2013.01); *F25D 23/087* (2013.01); *F25D 2323/021* (2013.01)

(58) Field of Classification Search
CPC ..... F25D 23/087; F25D 2323/021; F25D 23/028; F25D 23/025; F25D 2201/12; F25D 23/02; E05C 19/161; E06B 7/2309; E06B 7/2312; E05Y 2800/12
See application file for complete search history.

(56) References Cited

U.S. PATENT DOCUMENTS 5,694,789 A * 12/1997 Do ..... F25D 23/02 312/405
8,240,091 B2 8/2012 Cittadini et al.
2006/0188690 A1* 8/2006 Jun ..... F25D 23/087 428/99
2009/0314028 A1* 12/2009 Laible ..... F25D 23/087 62/449

(Continued)

FOREIGN PATENT DOCUMENTS

EP 1869379 B1 1/2010
EP 2762814 A1 * 8/2014 ..... F25D 23/02
JP 2004293912 A * 10/2004

*Primary Examiner* — Hiwot E Tefera
(74) *Attorney, Agent, or Firm* — Laurence A. Greenberg; Werner H. Stemer; Ralph E. Locher

(57) ABSTRACT

A sealing assembly seals an area between a door and a cabinet of a cooling device having a refrigeration compartment with two doors and a rotating bar pivotally mounted to one of the doors. The sealing assembly having a magnet chamber which defines a receiving cavity for accommodating a magnetic element, a first air chamber provided at one side of the sealing assembly, an attachment portion for attaching the sealing assembly to the door of the cooling device, a second air chamber provided between the magnet chamber and the first air chamber; and a first sealing flap adapted to form a closed region for sealing a space thereof. The sealing assembly further contains a second sealing flap extending as a free end towards the rotating bar. Moreover, a cooling device ideally contains such sealing assemblies.

16 Claims, 5 Drawing Sheets

(56) References Cited

U.S. PATENT DOCUMENTS

| | | | | |
|---|---|---|---|---|
| 2016/0273827 | A1* | 9/2016 | Almeida | F25D 23/02 |
| 2018/0073800 | A1* | 3/2018 | Okazaki | F25D 23/08 |
| 2018/0195792 | A1* | 7/2018 | Segawa | F25D 23/087 |
| 2018/0299189 | A1* | 10/2018 | Johnson | F25D 23/087 |
| 2020/0003481 | A1* | 1/2020 | Okazaki | E05C 19/161 |
| 2020/0011590 | A1* | 1/2020 | Johnson | E06B 7/2309 |

* cited by examiner

SEALING ASSEMBLY FOR COOLING DEVICE DOORS AND COOLING DEVICE HAVING THE SEALING ASSEMBLY

CROSS-REFERENCE TO RELATED APPLICATION

This application claims the priority, under 35 U.S.C. § 119, of Turkish Patent Application TR 2020/10040, filed Jun. 26, 2020; the prior application is herewith incorporated by reference in its entirety.

BACKGROUND OF THE INVENTION

Field of the Invention

The present invention relates to a sealing assembly for a cooling device, in particular for the refrigerator, to be mounted onto a door of the cooling device to reduce heat loss during the refrigeration cycle in the cooling device.

Conventional cooling devices typically have insulated freezer and refrigerating compartments which are disposed in either a side-by-side or top mount configuration. Accordingly, the cooling devices (i.e., refrigerators) can be classified based on a type of the storage compartments and a type of the doors, such as multi-door refrigerators.

In such multi-door refrigerators, there is a gap between doors that are arranged on the left and right sides, and leakage of cool air needs to be prevented. It is known to use a pivotally arranged sealing rotating bar on one of the doors, wherein the rotating bar needs to pivot to a certain angle in the process of opening or closing the door. Even though the rotating bar closes between the doors, there is a need for an enhanced sealing thereof. It is well known in the art to utilize sealing assemblies seal around the edges of the doors of the cooling devices. It is also known in the art that the sealing assembly is used with more than one air chambers, as shown in FIG. 5.

A prior art publication in the technical field, published European patent EP1869379 (B1), corresponding to U.S. Pat. No. 8,240,091, among others, discloses a gasket for refrigerator cabinets of the type including a soft bellows-type portion for sealing the area between a cabinet and a door, as well as a base portion able to fit the outer door and/or inner door of the refrigerator cabinet, wherein a shell is defined by the outer door and inner door filled with thermal insulation material.

Despite the use of heaters in cooling devices, condensation on the outer surface of a sealing assembly attached to doors may still be occurring. Since the conduction coefficient of a magnetic element is higher than the air and gasket material (i.e. rubber), the heat conduction is mostly done through the magnetic element. Therefore, heat insulation is adversely affected by the heat coming from the heater unit to the inside of the refrigerating compartment through the magnet. Thus, there is a need for a sealing assembly which enhances thermal insulation in multi-door cooling devices.

BRIEF SUMMARY OF THE INVENTION

An object of the present invention is to provide a sealing assembly for increasing the thermal insulation of the sealing assembly and preventing sweating that may occur on the outer surface of the sealing assembly.

The present invention proposes a sealing assembly for sealing an area between a door and a cabinet of a cooling device having a refrigeration compartment with two doors and a rotating bar pivotally mounted to one of the doors. The sealing assembly includes a magnet chamber which defines a receiving cavity for accommodating a magnetic element; a first air chamber provided at one side of the sealing assembly; an attachment portion for attaching the sealing assembly to the door of the cooling device; a second air chamber provided between the magnet chamber and the first air chamber; and a first sealing flap adapted to form a closed region for sealing a space thereof. The sealing assembly further contains a second sealing flap extending as a free end towards the rotating bar. This arrangement helps to reduce the thermal losses in the door and prevents sweating on the sealing assembly by improving the energy consumption level and humidity level class of the cooling device.

In a possible embodiment, the sealing assembly contains a contact wall forming an upper surface of the sealing assembly to contact the rotating bar. The microscopic gap may exist between the door and the opening, so that cold air within the storage room leaks out of the refrigerator. The contact wall helps to eliminate these gaps.

In a possible embodiment, the second air chamber has a polygonal cross-section, preferably a rectangular or a square cross-section.

In a possible embodiment, the magnet chamber, the first air chamber and the second air chamber are substantially aligned on the same horizontal axis. This arrangement increases the thermal efficiency and helps to maintain the components strictly together.

In a possible embodiment, the first sealing flap protrudes from the second air chamber towards an inner door face of a door for sealing a space thereof when the sealing assembly is attached to the door. As a consequence, the temperature of the inner surface of the sealing assembly is increased by means of the heat transfer via the transfer wall to the closed region, thereby minimizing the temperature difference between the inner and outer surfaces of the sealing assembly and eliminating the condensation problem at the outer surface of the sealing assembly at the same time.

In a possible embodiment, the sealing assembly contains an angle between the first sealing flap and the second air chamber in the range of 20°-80°, preferably in the range of 30°-50°. Thus, the closed region is created in the most appropriate and effective way.

In a possible embodiment, the second sealing flap protrudes from a side of the magnet chamber towards a front surface of the rotating bar for preventing air leakage when the door is closed. Thus, the second sealing flap helps to prevent heat and air leakage that may occur on the front surface of the rotating bar.

In a possible embodiment, the sealing assembly comprises an angle between the second sealing flap and the magnet chamber in the range of 90°-130°, preferably in the range of 95°-120°. Thus, the closed region is sealed in the most appropriate and effective way.

In a possible embodiment, the sealing assembly contains an inner air chamber provided between the magnet chamber and the attachment portion, with elastically deformable outer sidewalls. This arrangement increases the thermal efficiency and helps to maintain the components strictly together.

In a possible embodiment, the cooling device contains: a cabinet having a refrigeration compartment with two doors movably attached to the cooling device for closing the refrigeration compartment, each door having a sealing assembly; a rotating bar movably attached with respect to the at least one door, and two heat sources provided in the rotating bar with respect to the sealing assemblies for transferring heat to the sealing assembly.

In a possible embodiment, the second sealing flaps of the sealing assemblies extend to each other for sealing an area between the doors on a front surface of the rotating bar facing outside. Thus, the area between the doors on the front surface of the rotating bar is sealed, and heat and air leakage that may occur on the front surface of the rotating bar is prevented.

The second sealing flap can be made of a material which same as the material of the sealing assembly. The sealing assembly can be made of any kind of plastic materials, synthetic resin or rubber is preferred.

Other features which are considered as characteristic for the invention are set forth in the appended claims.

Although the invention is illustrated and described herein as embodied in an improved sealing assembly for cooling device doors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
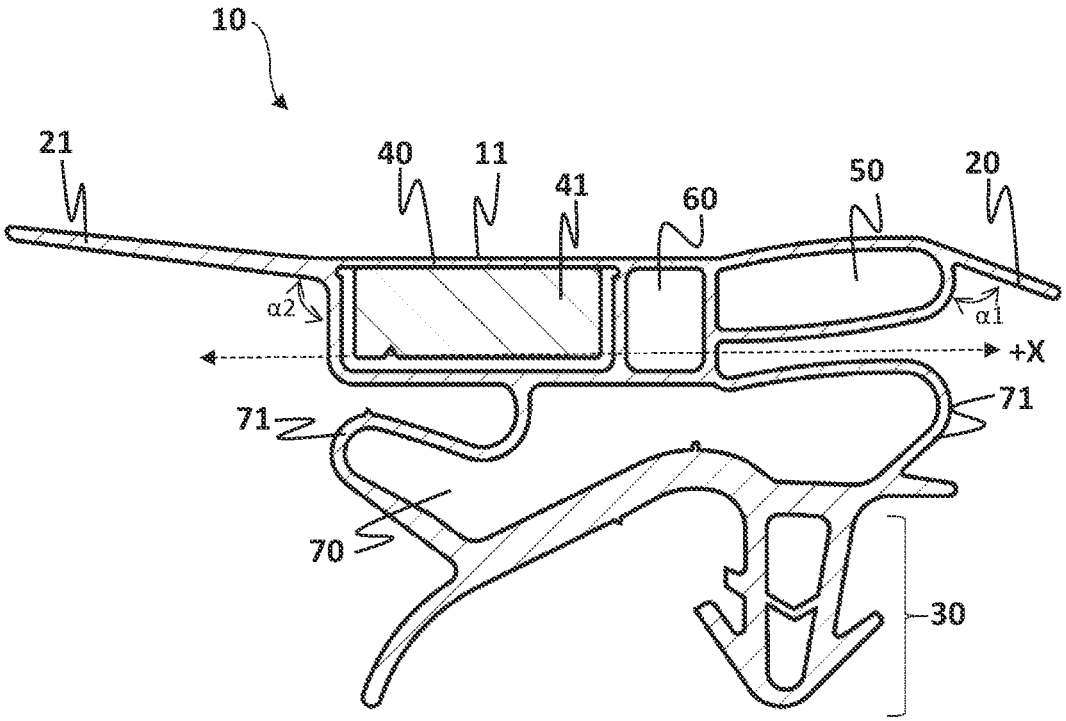
FIG. 1. is a diagrammatic, cross-sectional view of a sealing assembly according to the invention.

Referring now to the figures of the drawings in detail and first, particularly to FIG. 1 thereof, there is shown sealing assembly 10 for sealing an area between a door 101 and a cabinet 107 of a cooling device 100 having a refrigeration compartment 106 with multi doors 101 and a rotating bar 103 pivotally mounted to one of the doors 101. The sealing assembly 10 includes a magnet chamber 40 which defines a receiving cavity for accommodating a magnetic element 41; a first air chamber 50 provided at one side of the sealing assembly 10; an attachment portion 30 for attaching the sealing assembly 10 to the door 101 of the cooling device 100; a second air chamber 60 provided between the magnet chamber 40 and the first air chamber 50; and a first sealing flap 20 adapted to form a closed region 51 for sealing a space thereof. The sealing assembly 10 contains a second sealing flap 21 extending as a free end towards the rotating bar 103. The sealing assembly 10 contains a contact wall 11 forming an upper surface of the sealing assembly 10 to contact the cabinet 107.

According to the present invention, the sealing assembly 10 is arranged to surround the entire periphery of an interior surface of the door 101 and is formed of any kind of plastic materials that defines a number of collapsible air chambers.

Referring to FIG. 1, the first sealing flap 20 protrudes from the first air chamber 50 towards an inner door face 102 of a door 101 by forming the closed region 51 for sealing a space thereof when the sealing assembly 10 is attached to the door 101. This created closed region 51 is advantageous in keeping the inner surface of the sealing assembly 10 at a higher temperature, thereby ensuring the temperature difference between the inner and outer surfaces of the sealing assembly 10 as low as possible.

Referring to the FIG. 1, the sealing assembly 10 contains a first angle $\alpha 1$ between the first sealing flap 20 and the first air chamber 50 in the range of 20°-80°, preferably in the range of 30°-50°. With this arrangement, an end portion of the first sealing flap 20 abuts the inner door face 102 of the door 101 for forming the closed region 51. The degree of the inclination of the first sealing flap 20 can be arranged with respect to a different type of cooling device 100.

Figure 2:
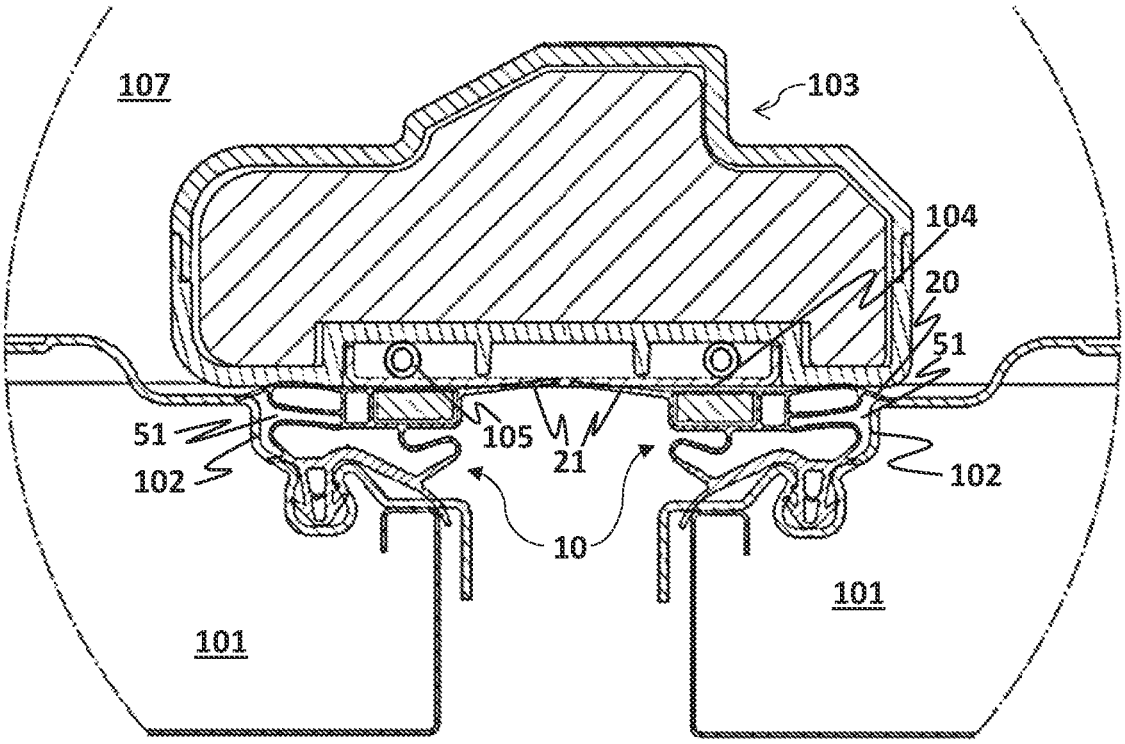
FIG. 2. is a cross-sectional view of the sealing assemblies placed in doors of a cooling device in opposite directions according to the present invention.

As seen in FIG. 2, the closed region 51 is formed by the first sealing flap 20 extending from the second air chamber 60 towards the inner door face 102 remaining inside the cabinet 107 when the door 101 is in a closed position. Advantageously, the first sealing flap 20 avoids any extra loss of heat towards the inner of the cabinet 107 by the orientation of the first sealing flap 20 between the sealing assembly 10 and the inner door face 102 of the cooling device 100.

Similarly, the second sealing flap 21 also protrudes from a side wall of the magnet chamber 40 towards a front surface 104 thereof for preventing air leakage when the door 101 is closed. As shown in FIG. 1, the sealing assembly 10 defines a second angle $\alpha 2$ between the second sealing flap 21 and the magnet chamber 40 in the range of 90°-130°, preferably in the range of 95°-120°. The second sealing flap 21 extends in the opposite direction with respect to the first sealing flap 20. This second sealing flap 21 is monolithic with the sealing assembly 10 and has a substantially predetermined thickness with a rounded free end portion. The degree of the inclination of the second sealing flap 21 can be arranged with respect to a different type of cooling device 100. In particular, the second sealing flap 21 protrudes from a side corner of the magnet chamber 40 towards the front surface 104 of the rotating bar 103.

As seen in FIG. 2, the second sealing flap 21 is arranged to use with the cooling device 100 having the rotating bar 103. The rotating bar 103, when the pair of doors are closed, is rotatably coupled to one of the doors, and is rotated to seal the gap in between the pair of doors 101. The sealing assembly 10, according to the present invention, can be used with the cooling device 100 having two doors 101 with the rotating bar 103. Referring to the FIGS. 3 and 4, the cooling device 100 as such, contains: a cabinet 107 having a refrigeration compartment 106 with two doors 101 movably attached to the cooling device 100 for closing the refrigeration compartment 106, each door 101 having a sealing assembly 10; a rotating bar 103 movably attached with respect to the at least one door 101, and two heaters 105 provided in the rotating bar 103 with respect to the sealing assemblies 10 for transferring heat to the sealing assembly 10.

Figure 3:
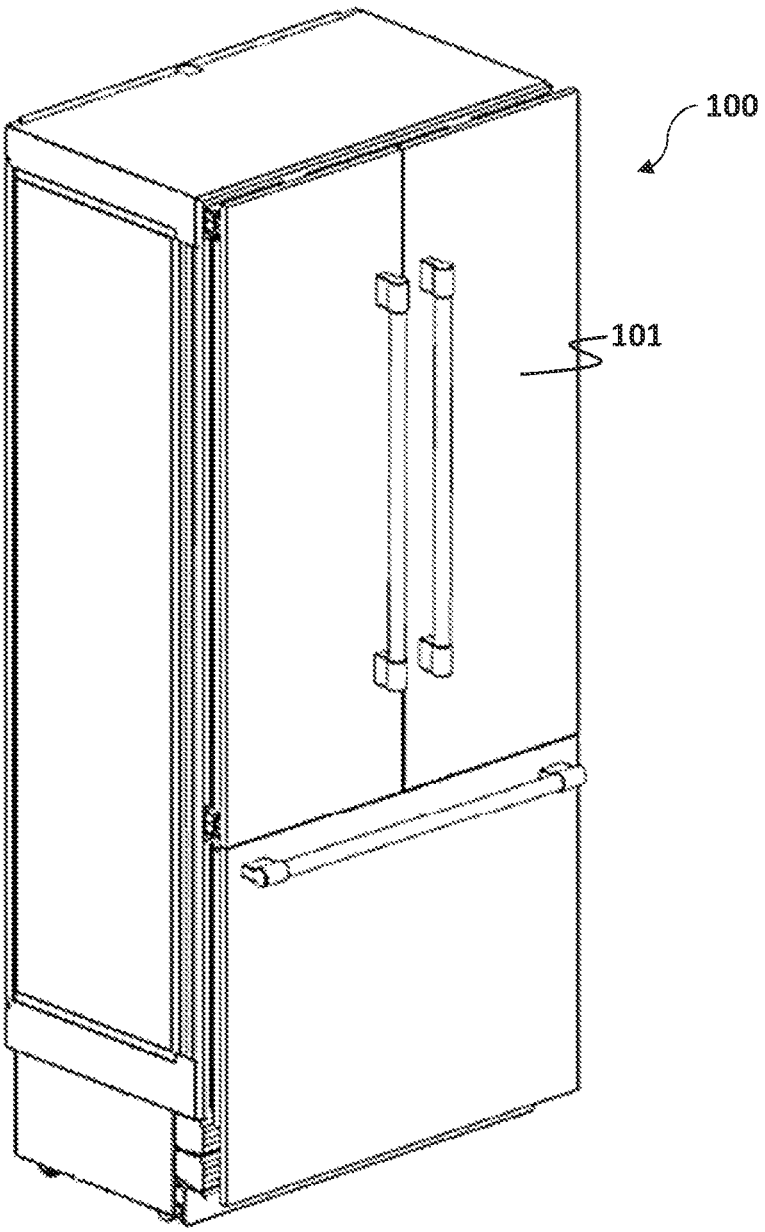
FIG. 3 is a perspective view of the cooling device in which the sealing assembly can be attached according to the present invention.
Figure 4:
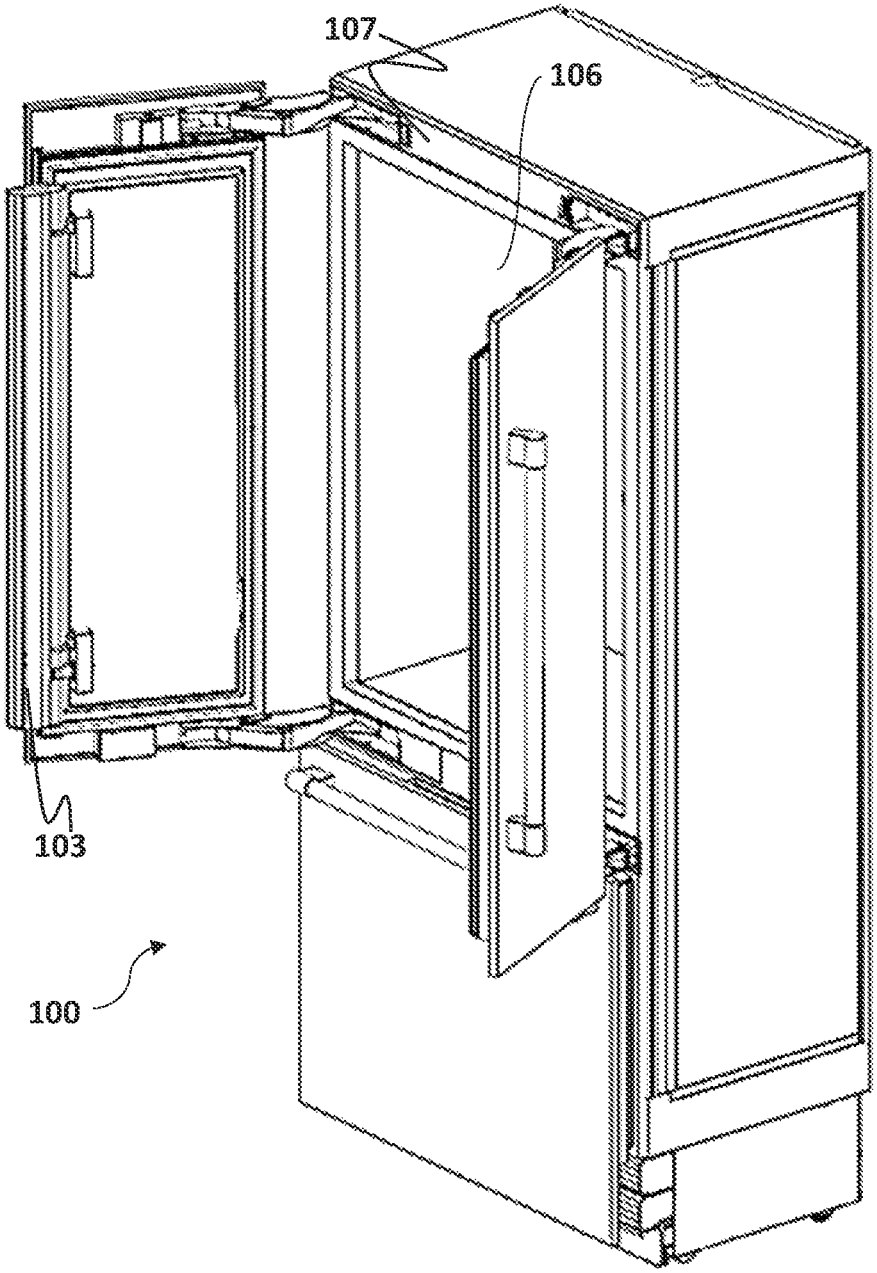
FIG. 4 is another perspective view of the cooling device shown in FIG. 3, according to the present invention.
Figure 5:
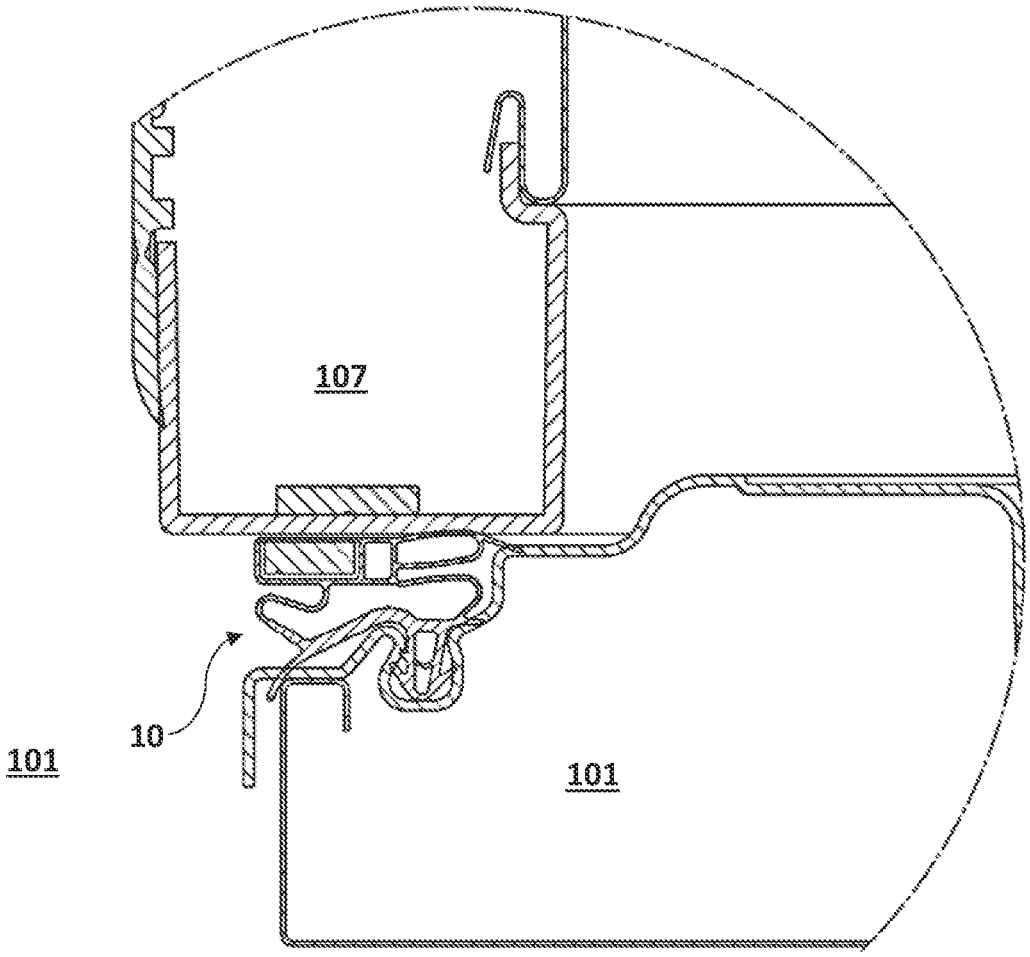
FIG. 5 (PRIOR ART)
FIG. 5 is a cross-sectional view of the sealing assembly attached to the cooling device according to the prior art.

The cooling device 100 can be a side-by-side (SBS)—type refrigerator which is provided therein with a storage compartment that is divided into a left side and a right side by a vertical partition while a freezing compartment is formed at one side and a refrigerating compartment 106 is formed at the other side. It can also be a French door refrigerator (FDR)—type refrigerator is provided therein with a storage compartment that is divided into an upper side and a lower side by a horizontal partition while the refrigerating compartment 106 at the upper side is open/closed by a pair of doors 101. When the sealing assemblies 10 are attached to the doors 101 of the SBS-type refrigerator or the FDR-type refrigerator, the second sealing flaps 21 of the sealing assemblies 10 extend to each other for sealing an area therebetween the doors 101 on the front surface 104 of the rotating bar 103 facing outside. Moreover, the door(s) 101 of the cooling device 100 can be secured by hinged attachment to an insulated body so that the door 101 will open away from the cabinet 107 while pivoting upon the hinged attachments. Furthermore, the heaters 105 may be attached to a rear surface of the rotating bar 103 to heat the rotating bar 103 when it is desired to remove condensation from the opposite face of the rotating bar 103 and the sealing assembly 10. When the doors 101 are in the closed position, the rotating bar 103 will be in the first position, as shown in FIG. 3, and the sealing assembly 10 will be engaged with the flat front surface 104 of the rotating bar 103. Afterwards, as the door 101 is rotated to an opened position, the rotating bar 103 rotatably moves with respect to the door 101 about a rotational axis.

The sealing assembly 10 includes an inner air chamber 70 provided between the magnet chamber 40 and the attachment portion 30, with elastically deformable outer side walls 71. The second air chamber 60 has a polygonal cross-section, preferably a rectangular or a square cross-section. Moreover, the magnet chamber 40, the first air chamber 50 and the second air chamber 60 are substantially aligned on the same horizontal axis (+X) as shown in FIG. 1.

The magnetic element 41 encased within the magnet chamber 40, is an elongated rectangle and is preferably a dual pole magnet having either north or south poles at each of its latitudinal ends.

The following is a summary list of reference numerals and the corresponding structure used in the above description of the invention:

10. Sealing assembly
11. Contact wall
20. First sealing flap
21. Second sealing flap
30. Attachment portion
40. Magnet chamber
41. Magnetic element
50. First air chamber
51. Closed region
60. Second air chamber
70. Inner air chamber
100. Cooling device
101. Door
102. Inner door face
103. Rotating bar
104. Front surface
105. Heater
106. Refrigeration compartment
107. Cabinet
+X Horizontal axis
$\alpha$1 First angle
$\alpha$2 Second angle

The invention claimed is:

1. A sealing assembly for sealing an area between a door and a cabinet of a cooling device having multiple doors and a rotating bar pivotally mounted to one of the doors, the sealing assembly comprising:

a magnetic element;

a magnet chamber defining a receiving cavity for accommodating said magnetic element;

a first air chamber provided at one side of the sealing assembly;

an attachment portion for attaching the sealing assembly to the door of the cooling device;

a second air chamber disposed between said magnet chamber and said first air chamber;

a contact wall being defined by a contact side of said first air chamber, said second air chamber, and said magnet chamber, said contact wall for contacting the rotating bar;

an inner air chamber disposed between said magnet chamber and said attachment portion, said inner air chamber overlapping said magnet chamber, said second air chamber and said first air chamber in a width direction of the sealing assembly;

said first air chamber having a first height from said contact wall, said second air chamber having a second height from said contact wall, said first height being less than said second height for offsetting a base side of said first chamber from a base side of said second chamber;

a first sealing flap adapted to form a closed region for sealing a space thereof; and a second sealing flap extending as a free end towards the rotating bar.

2. The sealing assembly according to claim 1, wherein said second air chamber has a polygonal cross-section.

3. The sealing assembly according to claim 1, wherein said magnet chamber, said first air chamber and said second air chamber are substantially aligned on a same horizontal axis.

4. The sealing assembly according to claim 1, wherein said first sealing flap protrudes from said first air chamber towards an inner door face of the door for sealing a space thereof when the sealing assembly is attached to the door.

5. The sealing assembly according to claim 4, wherein the sealing assembly defines a first angle between said first sealing flap and said first air chamber in a range of 20°-80°.

6. The sealing assembly according to claim 1, wherein said second sealing flap protrudes from a side of said magnet chamber towards a front surface of the rotating bar for preventing air leakage when the door is closed.

7. The sealing assembly according to claim 1, wherein the sealing assembly defines a second angle between said second sealing flap and said magnet chamber in a range of 90°-130°.

8. The sealing assembly according to claim 1, wherein said inner air chamber has elastically deformable outer side walls.

9. The sealing assembly according to claim 1, wherein said second air chamber has a rectangular or a square cross-section.

10. The sealing assembly according to claim 4, wherein the sealing assembly defines a first angle between said first sealing flap and said first air chamber in a range of 30°-50°.

11. The sealing assembly according to claim 7, wherein the sealing assembly defines a second angle between said second sealing flap and said magnet chamber in a range of 95°-120°.

12. The sealing assembly according to claim 1, wherein first sealing flap depends from said contact side of said first air chamber.

13. A cooling device, comprising:

a cabinet having a plurality of doors and a rotating bar pivotally mounted to one of said doors;

a sealing assembly for sealing an area between one of said doors and said cabinet, said sealing assembly containing:

a magnetic element;

a magnet chamber defining a receiving cavity for accommodating said magnetic element;

a first air chamber provided at one side of said sealing assembly;

an attachment portion for attaching said sealing assembly to said one door;

a second air chamber disposed between said magnet chamber and said first air chamber;

a contact wall being defined by a contact side of said first air chamber, said second air chamber, and said magnet chamber, said contact wall for contacting said rotating bar;

an inner air chamber disposed between said magnet chamber and said attachment portion, said inner air chamber overlapping said magnet chamber, said second air chamber and said first air chamber in a width direction of the sealing assembly;

said first air chamber having a first height from said contact wall, said second air chamber having a second height from said contact wall, said first height being less than said second height for offsetting a base side of said first chamber from a base side of said second chamber;

a first sealing flap adapted to form a closed region for sealing a space thereof; and a second sealing flap extending as a free end towards said rotating bar.

14. The cooling device according to claim 13, wherein:

said cabinet has a refrigeration compartment with two said doors movably attached to the cooling device for closing said refrigeration compartment, each of said doors having one said sealing assembly; and two heaters disposed in said rotating bar with respect to said sealing assemblies for transferring heat to said sealing assembly.

15. The cooling device according to claim 14, wherein said second sealing flaps of said sealing assemblies extend to each other for sealing an area between said doors on a front surface of said rotating bar facing outside.

16. The sealing assembly according to claim 13, wherein first sealing flap depends from said contact side of said first air chamber.

* * * * *